US005718003A

United States Patent [19]

Gwinn

[11] Patent Number: 5,718,003

[45] Date of Patent: Feb. 17, 1998

[54] PROTECTIVE BOXER SHORTS

[76] Inventor: Charles M. Gwinn, 4513 S. Meadows, Alvin, Tex. 77511

[21] Appl. No.: 509,448

[22] Filed: Jul. 31, 1995

[51] Int. Cl.[6] ..... A41B 9/02

[52] U.S. Cl. ..... 2/405; 2/403; 2/400

[58] Field of Search ..... 2/400, 403, 404, 2/401, 405; 602/69, 70, 71, 72, 73

[56] References Cited

U.S. PATENT DOCUMENTS

| | | | |
|---|---|---|---|
| 2,033,551 | 3/1936 | Rumery | 602/73 |
| 3,037,503 | 6/1962 | Ravaschieri | 2/403 |
| 3,459,181 | 8/1969 | Mann | 2/403 |
| 3,499,443 | 3/1970 | Scheerer | 602/73 |
| 5,070,869 | 12/1991 | Zhang | 2/403 |

FOREIGN PATENT DOCUMENTS

| | | | |
|---|---|---|---|
| 526678 | 6/1957 | Italy | 602/67 |

*Primary Examiner*—Gloria Hale

[57] ABSTRACT

An apparatus to be worn by human males as underwear for providing protection of the private parts, having a flexible and durable material attached to the inside of the underwear to form a pocket. Thus, having a means of supporting and separating the private parts to help protect them from injury and fungal type diseases. An apparatus, whereby when worn would not hinder normal movement.

9 Claims, 3 Drawing Sheets

PROTECTIVE BOXER SHORTS

BACKGROUND OF THE INVENTION

Heretofore, there has been primarily two types of male underwear, briefs and boxer. The brief type underwear provide support at the cost of being very tightly worn and not allowing proper air circulation between the legs and private parts. They cause skin irritation and rashes in between the legs in the crotch area. Because of the lack of enough air circulation between the legs, fungal diseases can be generated.

SUMMARY

This invention is easy to construct due to its simplicity and the materials are readily available. The cost of manufacturing this apparatus would be very low so as to make it affordable to most people. There is no special equipment necessary for its manufacture. All equipment and tools are standard and available. This apparatus would afford additional protection from injury and fungal contamination to it's wearer over and above it's predecessors. Due to the construction of this apparatus, the wearer not only gets the support and protection he needs, but, will also get the freedom needed for the circulation of air between the legs and the crotch area. This will keep this area cooler, thus reducing the growth of unwanted fungus and bacteria. The cost to manufacture this apparatus would be the same or a little higher than it's predecessors. In some cases it would be even lower. This apparatus, besides being worn by ordinary people, can also be worn by athletes. The supporting feature of this garment can be incorporated in male swim wear, basketball, tennis, and other athletic shorts or trunks.

Further objects and advantages of my invention will become apparent from a consideration of the drawings and ensuing description thereof.

DESCRIPTION OF THE PREFERRED EMBODIMENTS

Figure 1:
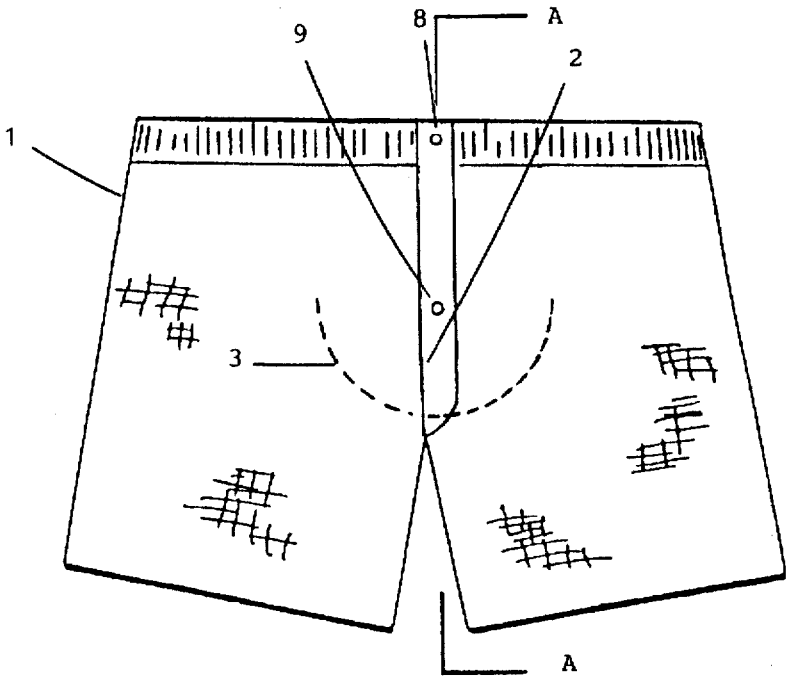
FIG. 1 illustrates a front view of the apparatus of this invention wherein boxer shorts 1 shown the support cup stitching 3 as the preferred embodiment of this invention. Top button 8 and bottom button 9 are attached to the top and bottom respectively, of fly 2 of boxer short 1.

FIG. 1 illustrates an embodiment of the apparatus of this invention wherein is illustrated a front view of boxer shorts 1. Boxer shorts 1 are constructed mainly of light weight, flexible materials, such as cotton, polyester, wool, silk, rayon or leather. The support cup stitching 3 is stitched in place by a sewing machine or by hand, and is made of similar material as the boxer shorts 1. Boxer shorts 1 has a fly 2 starting at the top and extending down to the support cup stitching. The use of fly 2 is to make it convenient for males to urinate without having to pull their underwear down. Top button 8 and bottom button 9 are used to fasten boxer shorts 1 and to keep them from falling down. Bottom button 9 is normally kept closed but can be unbuttoned when it is necessary for males to urinate. Top button 8 and bottom button 9 could be replaced by another type of fastener such as a snap type fastener, or a hook and loop (VELCRO) fastener.

Figure 2:
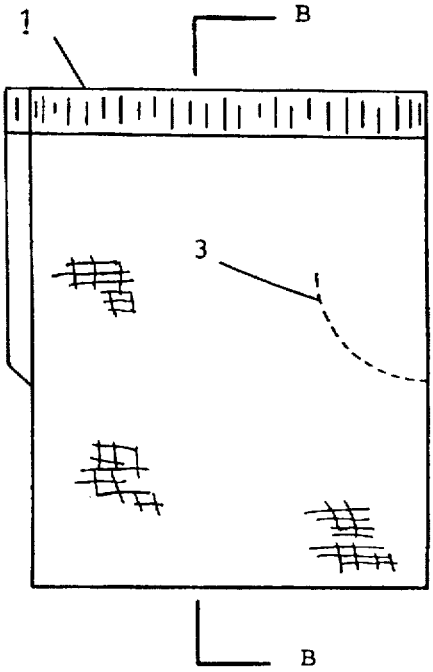
FIG. 2 would illustrate a side view of boxer shorts 1 wherein a one half portion of the support cup stitching 3 is visible.

FIG. 2 illustrates a side view of boxer shorts 1 wherein the support cup stitching 3 can be seen. Referring to FIG. 1, the left portion of the support cup stitching 3 is visible.

Figure 3:
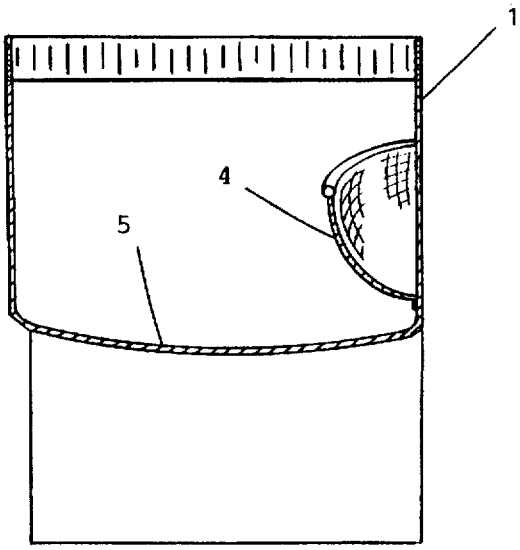
FIG. 3 would illustrate a sectional view, section A—A, of the preferred embodiment of FIG. 1 wherein an inside side view of boxer shorts 1 shows how support cup 4 is attached to the front portion of boxer shorts 1 just above crotch 5.

FIG. 3 illustrates a sectional view A—A of FIG. 1 which shows an inside view of boxer shorts 1 wherein is illustrated the preferred embodiment of this invention. The support cup 4 is attached to the inside front of boxer shorts 1 just above the crotch. Support cup 4 is constructed of a flexible durable and porous material, it also has elastic quality to allow for being stretched. When this invention is worn the top part of support cup 4 is pulled down and placed underneath the testicles and pushed back as far as possible, then released. The support cup 4 will tend to pull the testicles upward keeping them from dangling free.

Figure 4:
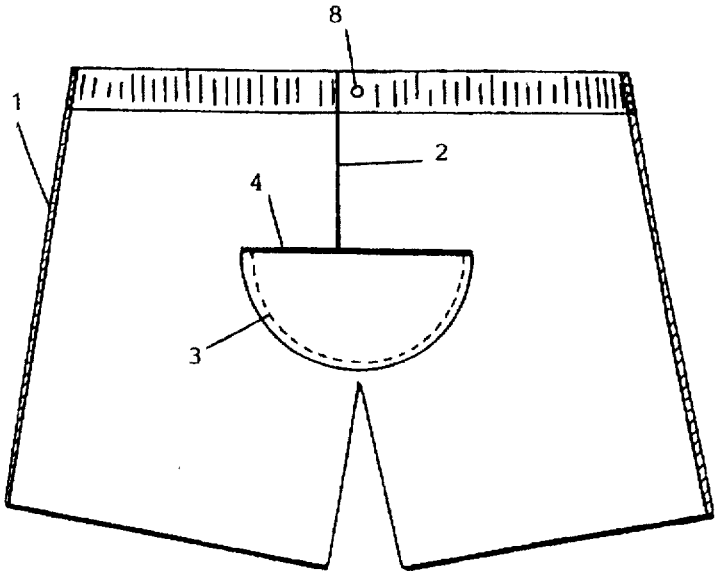
FIG. 4 would illustrate a sectional view, Section B—B, of FIG. 2 wherein an inside front view of boxer shorts 1. At the top of boxer shorts 1, attached in middle, is top button 8, to the right of fly 2. Support cup 4 is attached to the inside and front of boxer shorts 1 below top button 8. Support cup 4 is attached to boxer shorts 1 by support cup stitching 3.

FIG. 4 illustrates a sectional view B—B as shown in FIG. 2, wherein an inside front view of boxer shorts 1 is illustrated. Top button 8 is shown in the fastened position closing fly 2. Fly 2 can not be seen completely because of the fact that it is partially covered by support cup 4. Support cup 4 is hemispherically shaped and is sewn to the inside front panel of boxer shorts 1. Support cup stitching 3 is stitched around the perimeter of support cup 4 on three (3) sides, left, bottom, and right sides. The top portion, from left to right, is left open (unstitched) for the purpose of supporting the male genitals. While FIG. 4, does not depict the actual application of this invention, it is given to further clarify its construction.

Figure 5:
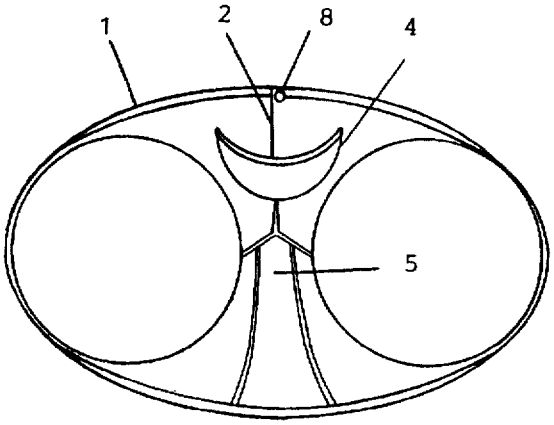
FIG. 5 illustrates a top view of boxer shorts 1 wherein support cup 4 is attached to the inside front portion of boxer shorts 1 just below top button 8 which is attached to the left of fly 2. Crotch 5 is shown at the bottom of boxer shorts 1.

FIG. 5 illustrates a top view of the preferred embodiment of this invention. In this view all the major parts are shown.

When this invention is put on, in a normal fashion, both feet are inserted and boxer shorts 1 are pulled up the legs of the wearer, whereby crotch 5 is pulled up against the crotch area of the wearer. The wearer would then hold the support cup 4 at the top and pull it down below his testicles and push it underneath and to the rear of the testicles, releasing it. Once the support cup 4 is in place (the top portion placed underneath and to the rear of the testicles) the fly 2 can be closed with top button 8. The testicles and penis are both protected inside the support cup 4.

Figure 6:
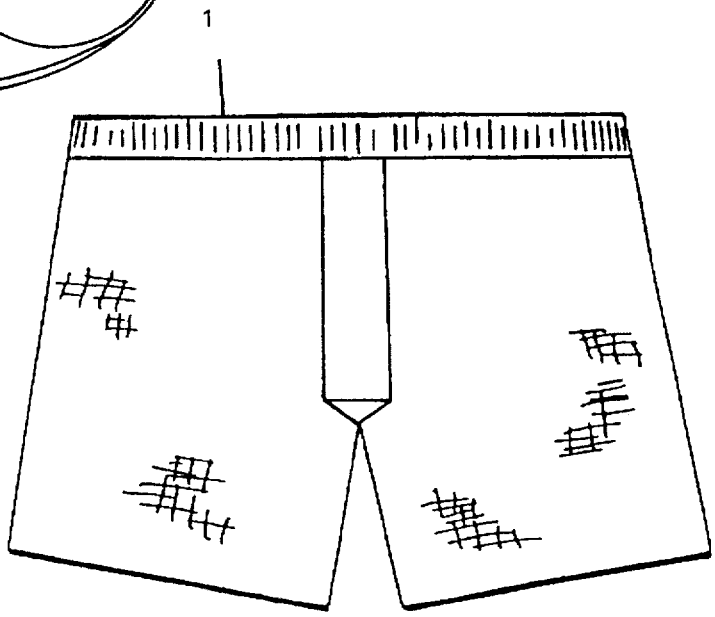
FIG. 6 illustrates a rear view of boxer shorts 1.

FIG. 6 illustrates a rear view of boxer shorts 1. This figure is illustrated to add clarity to the method of construction of this invention.

Figure 7:
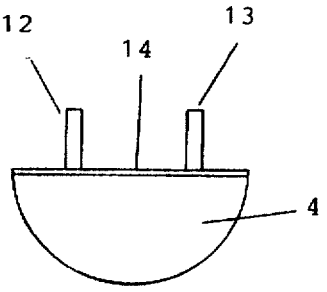
FIG. 7 illustrates a front view of the support cup 4, wherein elastic band 14 is attached across the top, from the left side to the right side of support cup 4. Right tab fastener 13 and left tab fastener 12 are attached, vertically, to the top, and on either side of support cup 4.

FIG. 7 illustrates a front view of the support cup 4 wherein its basic shape is seen as semicircular. Support cup 4 would function the same if its shape were rectangular, triangular, or elliptical. Support cup 4 would be constructed of a durable porous, light weight, flexible material such as cotton or synthetic material. Synthetic materials such as polyester, nylon, or rayon can be used alone or blended with other synthetic materials for the construction of support cup 4. Support cup 4 could be made of the same material as boxer shorts 1 illustrated in FIG. 1. Elastic band 14 would consist of an elastic material such as rubber, or a synthetic rubber, or a combination of elastic and non-elastic materials. Elastic band 14 would be constructed with an elastic material sewn into and horizontally across the top portion of support cup 4. Elastic band 14 would further consist of the top portion of support cup 4 containing a narrow pocket horizontally across the top portion of support cup 4, from the lift side to the right side, wherein the elastic material is contained inside the narrow horizontal pocket stretch and secured from the left side to the right side of support cup 4.

Left fastener 12 and right fastener 13 are for the purpose of preventing the male genitals from accidentally being removed from the support cup 4 due to vigorous activity such as, running, exercise, swimming, or hard strenuous work. Left fastener 12 is attached to the top portion and left of center of support cup 4. Right fastener 13 is attached to the top portion and right of center of the support cup 4. Each fastener would be constructed of HOOK AND LOOP FASTENER, when both fasteners are brought together they would adhere. Further construction of each fastener would consist of one fastener having a button hole in its free end, and the other fastener having a button permanently attached to its free end. The free end of each fastener is fastened together by inserting the button of one fastener into the button hole of the remaining fastener. Further construction of each fastener would consist of two cords or string-like material, whereby left fastener 12 and right fastener 13 would be attached to the left and right sides of the top portion of support cup 4, respecttively. When necessary the fastener would be tied together to facilitate further support of the male genitals. In all the above examples, the left and right fastener (12,13) would be attached to the top portion of support cup 4 by sewing, glueing, stapling, or buttoning.

Figure 8:
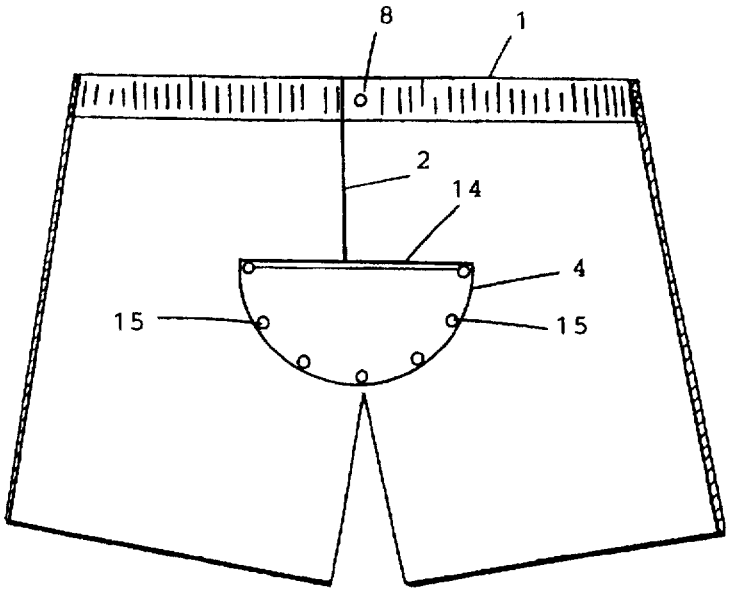
FIG. 8 illustrates an inside view of this invention, wherein support cup 4 is connected to boxer shorts 1 by several fasteners 15. Top button 8 and fly 2 are shown above the support cup 4. Elastic band 14 is connected to the top of support cup 4.

FIG. 8 illustrates an inside view of this invention ,wherein support cup 4 is shown attached to boxer shorts 1 with fasteners 15, which will allow support cup 4 to be removed from the boxer shorts 1. Fasteners 15 could consist of a snap type device, wherein one part of the device is attached to the support cup 4, and the remaining part is attached to the boxer shorts 1. Therefore, support cup 4 is attached to boxer shorts 1 by placing the the support cup in the proper position and snapping the two halves of each fastener together.

Fastener 15 could consist of a button and button hole arrangement, wherein the support cup 4 would be attached to boxer shorts 1.

Figure 9:
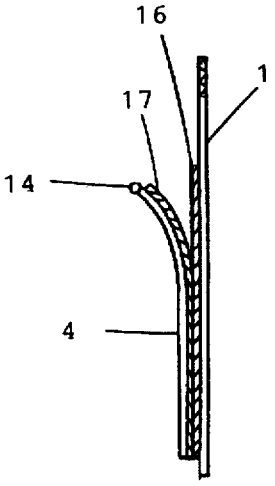
FIG. 9 illustrates a partial view, showing support cup 4 attached to the inside of boxer shorts 1 via HOOK AND LOOP FASTENER 16 and 17. One half of the HOOK AND LOOP FASTENER 17 is secured to support cup 4 and, the other half of the HOOK AND LOOP FASTENER 16 is secured to the inside surface of the boxer shorts 1.

FIG. 9 illustrates a partial side view of the support cup 4 connected to the inside surface of boxer shorts 1 using the Hook And LOOP FASTENER (16 and 17), wherein the loop 16 part of the fastener is secured to the boxer shorts 1, and the hook part 17 of the fastener is secured to support cup 4. When the support cup 4 is positioned properly, over the inside surface of boxer shorts 1, and with the two halves of the HOOK AND LOOP FASTENER (16 and 17) lined up properly, support cup 4 will adhere when pressed against boxer shorts 1.

Figure 10:
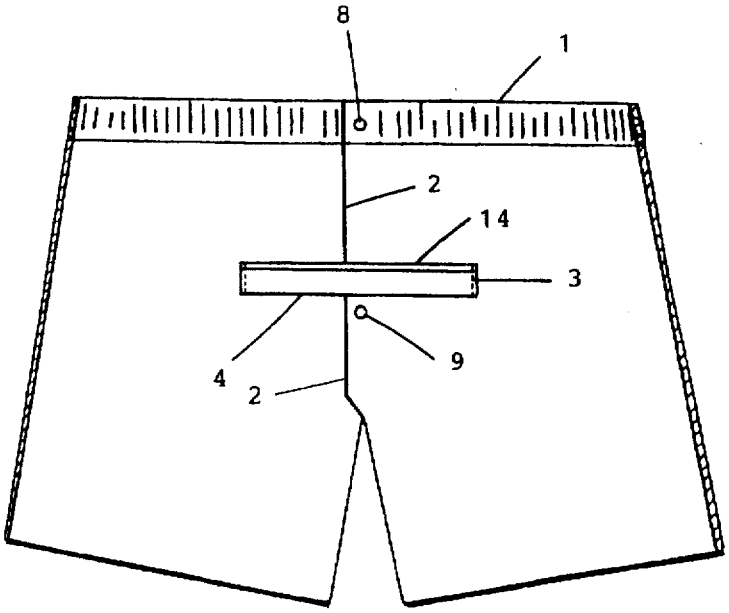
FIG. 10 illustrates an inside view of boxer shorts 1, wherein support cup 4 is attached to the inside surface of boxer shorts 1 by support cup stitches 3. Elastic band 14 is attached to the top of support cup 4. Top button 8 and bottom button 9 are shown connected to the right side of fly 2, above and below support cup 4.

FIG. 10 illustrates an inside view of this invention wherein support cup 4 is rectangular in shape. Support cup 4 is seen to be wider than it's length. Both sides of support cup 4 are attached to the inside surface of boxer shorts 1 by support cup stitching 3. The bottom part of support cup 4 is open from side to side. The top part of support cup 4, (elastic band 14) is also open from side to side. Support cup 4 is still worn the same as described above.

BROADENING PARAGRAPHS

While the above description contains many specificities, these should not be construed as limitations of one preferred example, the same physical protection could be provided using just a partial support cup instead of a full support cup. Accordingly, the scope of the invention should be determined not by the embodiment illustrated, but by the appending claims and their legal equivalents.

I claim:

1. An apparatus for the protection of the human male genitals, comprising:

(a) a men's boxer underwear having a front surface, a back surface, two bottom openings for legs, and a top opening for a torso; each front and back surface having an inside, b) a fly opening cut in said front surface of said men's boxer underwear allowing wearers to urinate by inserting the penis through said fly opening;

c) a piece of cloth having left and right sides, a top edge and a bottom edge attached to said inside front surface of said men's boxer underwear, wherein said piece of cloth covers said fly opening, whereby said left, bottom and right sides of said piece of cloth are attached to said inside front surface of said men's boxer underwear, and said top edge of said piece of cloth is unattached, thereby forming a pocket between said piece of cloth and inside surface of said men's boxer underwear, whereby the wearer would place the top edge of said piece of cloth under and to the rear of the testicles for the purpose of supporting and protecting the male genitals; and (d) an elastic band attached to the top edge of said piece of cloth, continuously from side to side to produce a snugger fit under the testicles.

2. An apparatus for the protection of male genitals, as recited in claim 1, wherein said piece of cloth consists of light weight, porous, flexible material.

3. An apparatus for the protection of male genitals, as recited in claim 1, wherein said men's boxer underwear are loose fitting in the legs, around the buttocks, and snuggly fitted around the waist.

4. An apparatus for the protection of the human male genitals, comprising:

(a) a men's boxer underwear having a front surface, a back surface, two bottom openings for legs, and a top opening for a torso; each front and back surface having an inside;

(b) a fly opening cut in said front surface of said men's boxer underwear allowing wearers to urinate by inserting the penis through said fly opening;

(c) a piece of cloth having left and right sides and top and bottom edges attached to said inside front surface of said men's boxer underwear, wherein said piece of cloth covers said fly opening, whereby said left and right sides of said piece of cloth are sewn to said inside front surface of said men's boxer underwear leaving said top and bottom edges of said piece of cloth unattached, thereby forming a pocket between said piece of cloth and said inside surface of said men's boxer underwear, whereby the wearer would place the top edge of said piece of cloth under and to rear of the testicles for the purpose of supporting and protecting the male genitals; and (d) an elastic band attached to said top edge of said piece of cloth, continuously from side to side to produce a snugger fit under the testicles.

5. An apparatus for the protection of male genitals, as recited in claim 4, wherein said piece of cloth is rectangular in shape, having a width greater than it is in length.

6. An apparatus for the protection of the human male genitals, comprising:

(a) a men's boxer underwear having a front surface, a back surface, two bottom openings for legs, and a top opening for a torso; each front and back surface having an inside;

(b) a fly opening cut in said front surface of said men's boxer underwear allowing wearers to urinate by inserting the penis through said fly opening;

(c) a piece of cloth having left and right sides and top and bottom edges attached to said inside front surface of said men's boxer underwear, wherein said piece of cloth covers said fly opening, whereby said left and right sides and said bottom of said piece of cloth are attached to said inside front surface of said men's boxer underwear, and said top edge of said piece of cloth is unattached, thus, forming a pocket between said piece cloth and inside part of said men's boxer underwear, whereby the wearer would place the top edge of said piece of cloth under and to rear of the testicles for the purpose of support and protection of the male genitals;

(d) an elastic band attached to said top edge of said piece of cloth, continuously from side to side to produce a snugger fit under the testicles; and (e) fasteners attached to the top left and top right sides of said piece of cloth, extending vertically, wherein said fasteners are made of a soft durable material, whereby said fasteners are connected together at their free ends after the genitals are in the proper position, wherein said fasteners are for the purpose of keeping the genitals from slipping out of pocket formed by said piece of cloth and inside surface of said men's boxer underwear.

7. An apparatus for the protection of male genitals, as recited in claim 6, wherein said fastener's free ends are connected by hook and loop fastener.

8. An apparatus for the protection of male genitals, as recited in claim 6, wherein said fastener's free ends are connected by a button and button hole type fastener.

9. An apparatus for the protection of the human male genitals, comprising:

(a) a men's boxer underwear having a front surface, a back surface two bottom openings for legs, and a top opening for a torso; each front and back surface having an inside;

(b) a fly opening cut in said front surface of said men's boxer underwear allowing wearers to urinate by inserting the penis through said fly opening;

(c) a piece of cloth having left and right sides and top and bottom edges attached to inside front surface of said men's boxer underwear, wherein said piece of cloth covers said fly opening, whereby left and right sides, and said bottom edge of said piece of cloth are attached to said inside front surface of said men's boxer underwear, and said top edge of said piece of cloth is unattached, thereby, forming a pocket between said piece of cloth and said inside surface of said men's boxer underwear, whereby the wearer would place said top edge of said piece of cloth under and to the rear of the testicles for the purpose of supporting and protecting the male genitals;

(d) an elastic band attached to said top edge of said piece of cloth, continuously from side to side to produce a snugger fit under the testicles; and (e) a fastening means to attach said piece of cloth to said inside front surface of said men's boxer underwear for the purpose of removing said piece of cloth from said men's boxer underwear.

* * * * *